US009346284B2

(12) United States Patent
Moriya

(10) Patent No.: US 9,346,284 B2
(45) Date of Patent: May 24, 2016

(54) IMAGE FORMING APPARATUS CONFIGURED TO GIVE IMAGE FAILURE NOTIFICATION

(71) Applicant: Shinta Moriya, Kanagawa (JP)

(72) Inventor: Shinta Moriya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/141,891

(22) Filed: Dec. 27, 2013

(65) Prior Publication Data

US 2014/0218430 A1 Aug. 7, 2014

(30) Foreign Application Priority Data

Feb. 6, 2013 (JP) ..... 2013-021839

(51) Int. Cl.
*B41J 29/38* (2006.01)
*B41J 2/21* (2006.01)

(52) U.S. Cl.
CPC ..... *B41J 2/2146* (2013.01); *B41J 2/2142* (2013.01)

(58) Field of Classification Search
None
See application file for complete search history.

(56) References Cited

U.S. PATENT DOCUMENTS

| | | | | |
|---|---|---|---|---|
| 7,328,960 | B2 | 2/2008 | Sakagami et al. | |
| 7,845,757 | B2 | 12/2010 | Nishiyama | |
| 7,845,786 | B2 | 12/2010 | Konno | |
| 8,366,257 | B2 | 2/2013 | Sasaki et al. | |
| 2005/0146543 | A1 * | 7/2005 | Smith et al. | 347/6 |
| 2006/0158477 | A1 * | 7/2006 | Kusakari et al. | 347/19 |
| 2007/0064077 | A1 * | 3/2007 | Konno | 347/102 |
| 2009/0244164 | A1 * | 10/2009 | Nakamaki et al. | 347/19 |
| 2010/0091053 | A1 * | 4/2010 | Jackson et al. | 347/9 |
| 2011/0069101 | A1 * | 3/2011 | Buschmann | 347/14 |

FOREIGN PATENT DOCUMENTS

| | | |
|---|---|---|
| JP | 2004-050450 | 2/2004 |
| JP | 3867788 | 1/2007 |
| JP | 2007-106114 | 4/2007 |
| JP | 2009-184123 | 8/2009 |
| JP | 2012-096516 | 5/2012 |

* cited by examiner

*Primary Examiner* — Bradley Thies
(74) *Attorney, Agent, or Firm* — Cooper & Dunham LLP

(57) ABSTRACT

An image forming apparatus includes a liquid discharge head including a plurality of nozzles discharging liquid droplets; a discharge failure detection unit detecting a defective nozzle of the liquid discharge head, the defective nozzle having a discharge failure; and a notification unit giving, when the defective nozzle is detected during image formation, a notification of the possibility of the generation of an image failure at least one of during and after the image formation.

5 Claims, 12 Drawing Sheets

IMAGE FORMING APPARATUS CONFIGURED TO GIVE IMAGE FAILURE NOTIFICATION

CROSS-REFERENCE TO RELATED APPLICATIONS

The present application is based on and claims the benefit of priority under 35 U.S.C §119 of Japanese Patent Application No. 2013-021839 filed on Feb. 6, 2013, the entire contents of which are hereby incorporated herein by reference.

BACKGROUND OF THE INVENTION

1. Field of the Invention

The present invention relates to an image forming apparatus.

2. Description of the Related Art

As an image forming apparatus such as a printer, a facsimile machine, a plotter, a multi-functional peripheral of such apparatuses and the like, there has been known an inkjet recording apparatus which is an image forming apparatus employing a liquid-discharge recording method using a recording head including a liquid discharge head (liquid droplet discharge head) that discharges, for example, ink droplets.

As an operation in such an image forming apparatus, a recovery operation (maintenance operation) of the recording head is know which is performed after detecting a "discharge failure" (a.k.a., for example, "nozzle damage" or "nozzle drop out") and stopping the print operation.

In the recovery operation, it is known that, for example, as soon as the discharge failure is detected, printing is stopped. Then, a maintenance operation is performed in accordance with the cause of the discharge failure so as to restore the damaged nozzle (see, for example, Japanese Patent No. 3867788).

SUMMARY OF THE INVENTION

According to an aspect of the present invention, an image forming apparatus includes a liquid discharge head including a plurality of nozzles discharging liquid droplets; a discharge failure detection unit detecting a defective nozzle of the liquid discharge head, the defective nozzle having a discharge failure; and a notification unit giving, when the defective nozzle is detected during image formation, a notification of the possibility of the generation of an image failure at least one of during and after the image formation.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In some image forming apparatuses, there may be a recovery (maintenance) operation performed. In such a recovery operation, it is known that, for example, as soon as a discharge failure is detected, printing is stopped and maintenance operation is performed in accordance with the cause of the discharge failure so as to restore the damaged nozzle.

However, in a case where the image forming apparatus is, for example, a line-type image forming apparatus in which printing is performed on a continuous recording medium (i.e., for example, a roll sheet, a continuous form, a ledger (record) sheet, a web medium), even when a damaged nozzle is detected during printing, it is not possible to stop printing for the recovery.

Therefore, for example, when a nozzle drop out is detected, a printed result may include remarkable failure of an image which is overlooked.

The present invention is made in light of the problem, and provides an image forming apparatus capable of preventing the situation such that a failure of an image due to nozzle failure (damage) is overlooked during printing.

Figure 1:
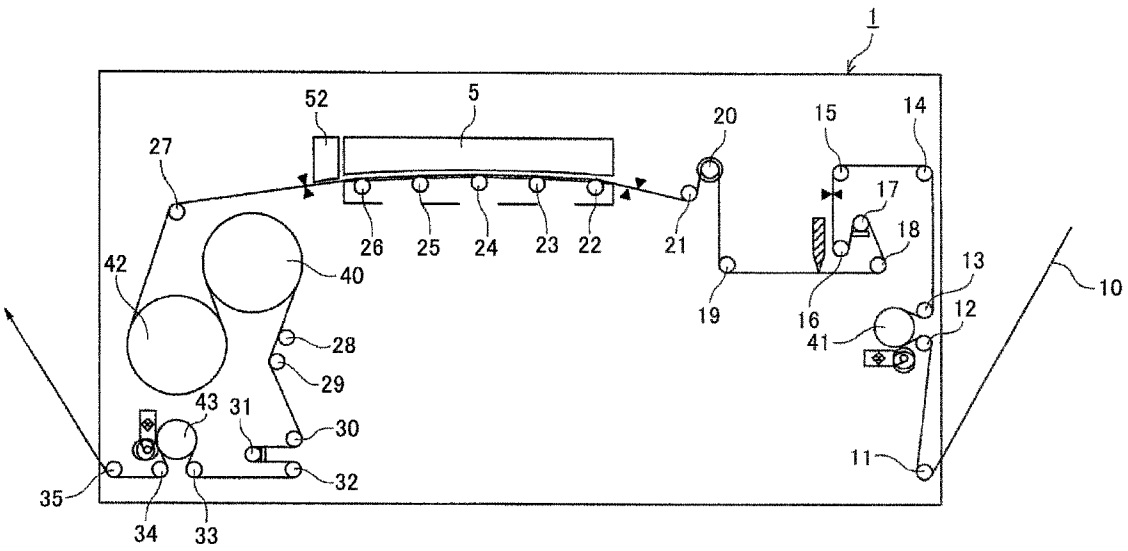
FIG. 1 schematically illustrates an example of an overall configuration of an image forming apparatus according to an embodiment.

In the following, embodiments of the present invention are described with reference to the accompanying drawings. First, an example of an image forming apparatus according to an embodiment is described with reference to FIG. 1. FIG. 1 schematically illustrates an example of overall configuration of the image forming apparatus.

The image forming apparatus herein is a fill-line type inkjet recording apparatus. In the image forming apparatus, a recording medium 10 is a continuous form and is supplied from the outside of the apparatus main body 1 (FIG. 1).

After an image is formed on the recording medium 10, the recording medium is output (discharged) from the apparatus main body 1. After that, various processes for cutting, winding, binding a book and the like are performed on the recording medium 10 by a post processor (not shown).

After being fed to the apparatus main body 1, the recording medium 10 is further fed due to the feed driving force supplied by rollers 11-35, a heat roller 40, and motors 41, 42, and 43, and discharged to the outside of the apparatus main body 1.

The recording medium 10 is guided and supported by the rollers 22-26 so that the recording medium 10 is fed while facing an image formation section 5. While feeding, an image is formed on the recording medium 10 by the liquid droplets discharged from the image formation section 5.

Here, the image formation section 5 includes a recording heads 51A-51D, serving as a first liquid discharge head, that discharge ink droplets, which are recording liquid, to the recording medium 10.

The recording heads 51A-51D (hereinafter may be simplified as "recording head(s) 51" when it is not necessary to distinguish one from another) includes a plurality of heads 100 arranged in a zigzag manner to form one line. Each of the heads 100 includes two nozzle lines, and each of the nozzle lines include nozzles 104.

The recording heads 51A-51D discharge, for example, yellow (Y), cyan (c), magenta (m), and black (k) color ink droplets, respectively. It should be noted that the present invention is not limited to the color types and the number of colors described herein.

Figure 2:
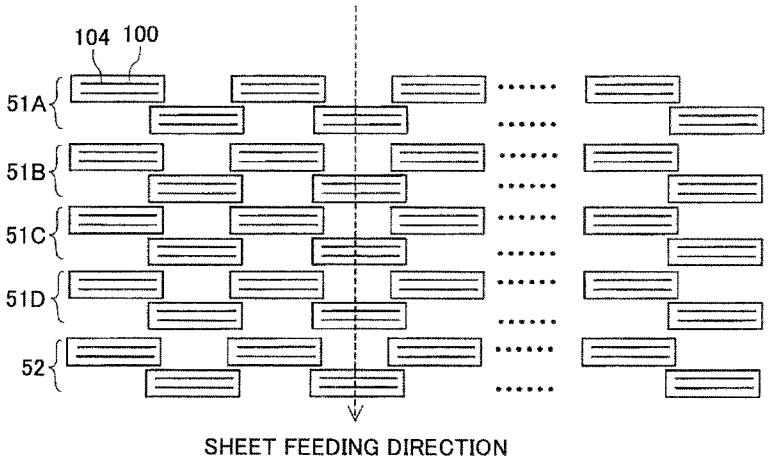
FIG. 2 is a top view illustrating an example arrangement of a recording head of an image formation section of the image forming apparatus.

As illustrated in FIG. 2, the image formation section 5 further includes a processing (pre-process) liquid head 52, which serves as a second liquid discharge head, disposed on the downstream side of the recording head 51D which is the first liquid discharge head.

Similar to the recording head 51, the processing liquid head 52 includes a plurality of heads 100 arranged in a zigzag manner to form one line. Each of the heads 100 includes two nozzle lines, and each of the nozzle lines include nozzles 104.

The processing liquid head 52 discharges a transparent liquid (processing liquid) to improve the quality of printing by improving, for example, the fixing performance (called an "overcoat") or glossiness of the image.

Figure 3:
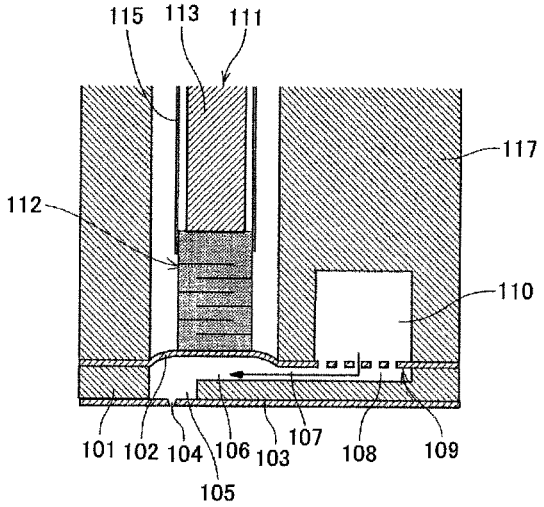
FIG. 3 is a cross-sectional view of an example liquid discharge head when cut along the longitudinal direction of a liquid chamber of the recording head (i.e., the direction orthogonal to the nozzle arranging direction)
Figure 4:
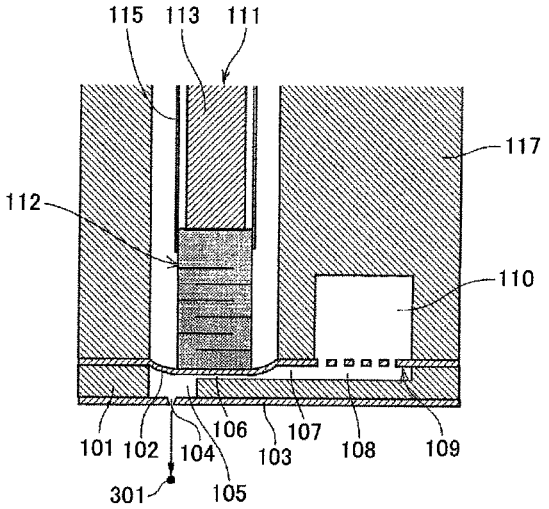
FIG. 4 is another cross-sectional view of the liquid discharge head cut along the longitudinal direction of a liquid chamber of the recording head when liquid droplets are discharged.

Next, an example of a liquid discharge head included in the recording head 51 and the processing liquid head 52 is described with reference to FIGS. 3 and 4. FIGS. 3 and 4 are cross-sectional views of the liquid discharge head when cut along the longitudinal direction of a liquid chamber of the recording head (i.e., the direction orthogonal to the nozzle arranging direction).

In the liquid discharge head, a flow path plate 101, a vibration plate member 102, and a nozzle plate 103 are laminated on each other. By doing this, an individual chamber 106 in communication with the nozzle 104 via a through hole 105, a liquid resistance section 107, and a liquid introduction section 108 are formed which supply a liquid to the individual chamber 106 are formed.

The individual chamber 106 may include the means of a liquid chamber, a pressurized chamber, a pressurized liquid chamber, a pressure chamber, an individual path, a pressure generation chamber or the like.

Further, a liquid (ink) in a common liquid chamber 110 formed in a frame member 117 is supplied (introduced) to the liquid introduction section 108 through a filter section 109 formed in the vibration plate member 102. Then, the liquid (ink) in the liquid introduction section 108 is further supplied to the individual chamber 106 via the liquid resistance section 107.

The flow path plate 101 is formed by laminating a metal plate such as SUS, so as to form the opening parts and the groove parts of the through hole 105, the individual chamber 106 the liquid resistance section 107, the liquid introduction section 108 and the like.

The vibration plate member 102 serves as the wall surface member forming the wall surfaces of the individual chamber 106, the liquid resistance section 107, the liquid introduction section 108 and the like, and further serves as a member forming the filter section 109. Here, the flow path plate 101 is not limited to be made of a metal plate such as SUS, and may be formed by performing anisotropic etching on a silicon substrate.

Further, there is a laminated-type piezoelectric member 112 jointed with (formed on) one surface of the vibration plate member 102 opposite to the other surface facing the individual chamber 106. The laminated-type piezoelectric member 112, which serves as a pressure generation unit (an actuator unit), has a pillar shape and generates energy to press the individual chamber 106 to discharge liquid droplets from the nozzle 104.

Further, one end of the laminated-type piezoelectric member 112 is jointed with a base member 113, and the laminated-type piezoelectric member 112 is electrically connected to an FPC 115 in which a driving waveform travels. The laminated-type piezoelectric member 112, the base member 113, and the FPC 115 constitutes a piezoelectric actuator 111 (FIG. 3).

Further, in this embodiment, it is assumed that laminated-type piezoelectric member 112 uses "d33" mode in which the laminated-type piezoelectric member 112 extents and contracts in the laminated layer direction. However, for example, the "d31" mode in which the laminated-type piezoelectric member 112 extents and contracts in the direction orthogonal to the laminated layer direction may be used.

In the liquid discharge head having such a configuration as described above, for example, as illustrated in FIG. 3, by reducing the voltage applied to the laminated-type piezoelectric member 112 from a reference voltage "Ve", the laminated-type piezoelectric member 112 contracts. By doing this, the vibration plate member 102 is deformed accordingly so that the volume of the individual chamber 106 expands, thereby introducing ink into the individual chamber 106.

After that, as illustrated in FIG. 4, when the voltage applied to the laminated-type piezoelectric member 112 is increased, the laminated-type piezoelectric member 112 extends. By doing this, the vibration plate member 102 is deformed accordingly so that the volume of the individual chamber 106 contracts, thereby increasing the pressure in the individual chamber 106 to discharge liquid droplets 301 (i.e., recording liquid or processing liquid) from the nozzle 104.

Then, by returning the voltage applied to the laminated-type piezoelectric member 112 to the reference voltage "Ve", the vibration plate member 102 returns to its initial position, and the individual chamber 106 expands to generate a negative pressure. Then, the individual chamber 106 is filled with ink supplied from the common liquid chamber 110. As a result, the vibration of the meniscus surface is attenuated and stabilized, and then, the process enters to a step of waiting for the next discharge of the liquid droplets.

Figure 5:
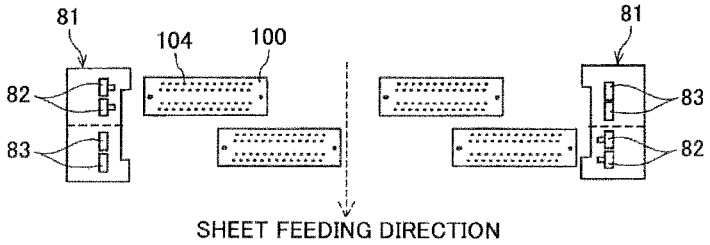
FIG. 5 illustrates an example of a detecting section of a discharge failure detection unit.

Next, an example of a discharge failure detection unit is described with reference to FIG. 5. FIG. 5 illustrates a detecting section of the discharge failure detection unit.

The discharge failure detection unit includes two light emitting and receiving units 81 corresponding to the recording heads 51.

The light emitting and receiving unit 81 includes a laser diode ("LD") 82, and optical system (not shown), and a photo diode ("PD") 83. The LD 82 serves as an light emitting unit that emits laser light in the nozzle arranged direction of the nozzles 104. The PD 83 serves as a light receiving unit that receives the laser light emitted by another LD 81.

When laser light emitted from the LD 82 is blocked by the recording liquid or the processing liquid, it is determined (detected) that the recording liquid or the processing liquid is normally (correctly) ejected. However, if the laser light emitted from the LD 82 is incident in the PD 83 without being blocked by the recording liquid or the processing liquid, it is determined that an ejection failure occurs.

Figure 6:
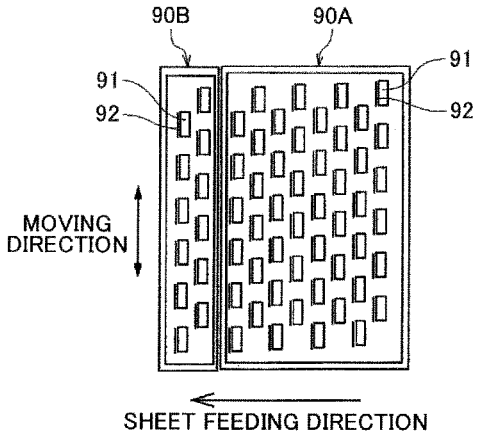
FIG. 6 is a top view illustrating an example of a maintenance unit.
Figure 7:
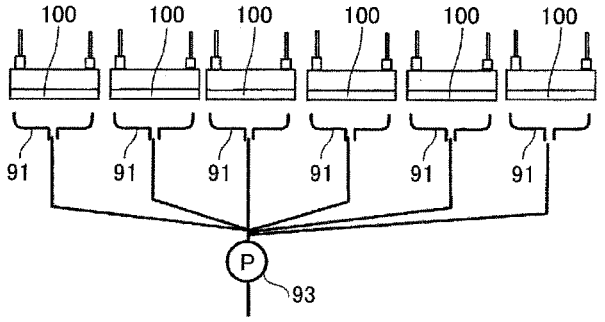
FIG. 7 is a front view schematically illustrating a cap part.

Next, an example of a maintenance unit that performs maintenance on the recording head 51 and the processing liquid head 52 is described with reference to FIGS. 6 and 7. FIG. 6 is a top view illustrating the maintenance unit, and FIG. 7 is a front view schematically illustrating a cap part. In the figures, for simplification purposes, it is assumed that the number of recording heads in one column is six.

A maintenance unit 90 includes a recording-head maintenance unit 90A and a processing-liquid head maintenance unit 90B.

The recording-head maintenance unit 90A and the processing-liquid head maintenance unit 90B includes respective caps 91 and wiping members (wiper members) 92. The caps 91 cap (seal) the respective nozzle surfaces of the heads 100 arranged in rows (lines). The wiping members (wiper members) 92 wipe the respective nozzle surfaces.

Further, in the caps 91 arranged in rows, there are provided respective suction pumps 93. The suction pumps 93 serving as suction units that absorb ink via the respective nozzles while the nozzle surfaces are being capped.

The maintenance unit 90 is moved in the moving direction orthogonal to the sheet feeding direction of FIG. 6 under the recording heads 51 and the processing liquid heads 52 so that the recording-head maintenance unit 90A and the processing-liquid head maintenance unit 90B are moved to the positions under the corresponding recording heads 51 and the processing liquid heads 52.

At positions, the caps 91 and the wiping members (wiper members) 92 are moved up or down relative to the recording heads 51 and the processing liquid heads 52. BY doing this, the nozzle surfaces are capped or decapped, and the wiping members (wiper members) 92 are moved to the wiping position or the evacuation position.

Here, while the nozzle surfaces are capped by the caps 91, a maintenance operation is performed in which the suction pumps 93 are driven so as to forcibly discharge ink from the nozzles (absorption discharge).

In this case, on the side of the recording heads 51 and the processing liquid heads 52, there may be provided a liquid feeding pump(s) (not shown) to apply pressure so as to supply ink. By using the liquid feeding pump(s), it becomes easier to perform the maintenance operation by assisting the absorption discharge.

Figure 8:
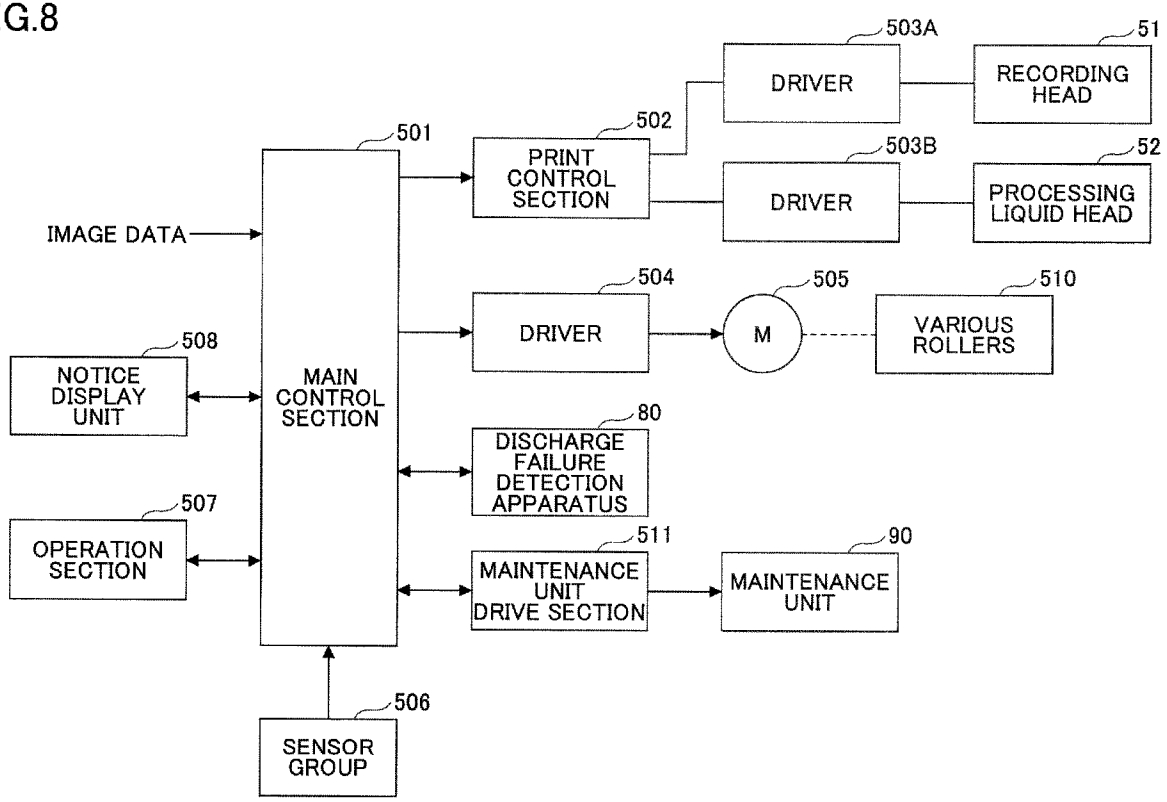
FIG. 8 is an example block diagram schematically illustrating a control section of the image forming apparatus.

Next, an outline of a control section of the image forming apparatus is described with reference to FIG. 8. FIG. 8 is an example block diagram schematically illustrating the control section of the image forming apparatus.

The control section includes a main control section (system controller) 501 which controls overall image forming apparatus. The main control section (system controller) 501 includes a micro computer, which performs control of, for example, notifications in the present application maintenance, image memory, and the communication interface.

The main control section (system controller) 501 transmits print data to a print control section 502 to form an image on a sheet based on the image data and the information of various commands transmitted from an external information processing apparatus (host side).

The print control section 502 receives image data from the main control section (system controller) 501, and transmits the image data in serial data along with the transmission clock signal, the latch signal, the control signal and the like, which are necessary for transmission of the image data and ensuring the transmission, to a head drivers 503A and 503B.

Further, the print control section 502 includes a drive signal generation section, which includes a D/A converter performing D/A (digital to analog) conversion on pattern data of a drive pulse stored in a ROM, a voltage amplifier, a current amplifier and the like, so as to output a drive signal including one or more drive pulses to the head drivers 503A and 503B.

The head driver 503A serves as a pressure generation unit to drive the recording head 51 by selecting the drive pulse transmitted from the print control section 502 for forming drive waveform based on the image data, so as to apply the drive pulse to the laminated-type piezoelectric member 112.

In this case, for example, it becomes possible to form (eject) dots having different sizes such as large droplets, middle droplets, and small droplets by selecting a part or all of the pulses of the drive waveform or selecting a part or all of the waveform element forming the pulse.

The head driver 503B also serves as the pressure generation unit to drive the processing liquid heads 52 by selecting the drive pulse transmitted from the print control section 502 for forming drive waveform based on the image data, so as to apply the drive pulse to the laminated-type piezoelectric member 112.

In this case, for example, it become possible to form (eject) dots having different sizes such as large droplets, middle droplets, and small droplets by selecting a part or all of the pulses of the drive waveform or selecting a part or all of the waveform element forming the pulse.

Further, the main control section (system controller) 501 rotatably drives various rollers 510 via a motor driver 504 by driving various motors 505.

Further, the main control section (system controller) 501 inputs the detection signals from a sensor group 506 including various sensors 506. Further, the main control section (system controller) 501 inputs and outputs various information and exchanges display information with an operation section 507. Further, the main control section (system controller) 501 exchanges notification display information with a notification display unit 508.

Further, the main control section (system controller) 501 drives and controls the light emitting and receiving unit 81 included in a discharge failure detection apparatus 80, and determines (detects) a discharge failure of the recording heads 51.

Based on the detection result, the main control section (system controller) 501 further determines whether the nozzle where the droplet discharge failure is detected (hereinafter "discharge failure nozzle" or "defective nozzle") is (to be) used for forming the image.

Further, when image formation is being started, the discharge failure detection apparatus 80 detects the discharge failure nozzle. When the detected discharge failure nozzle is to be used for image formation, a possibility that the discharge failure nozzle is to be used for image formation is notified to a user via a notification display unit 508 or the like. The notification is displayed (given) at least either during the image formation or after the image formation.

Further, the main control section (system controller) 501 drives and controls the maintenance unit 90 via a maintenance unit drive section 511 to perform a maintenance and recovery ("maintenance") operation on the recording head 51 and the processing liquid head 52.

Figure 9:
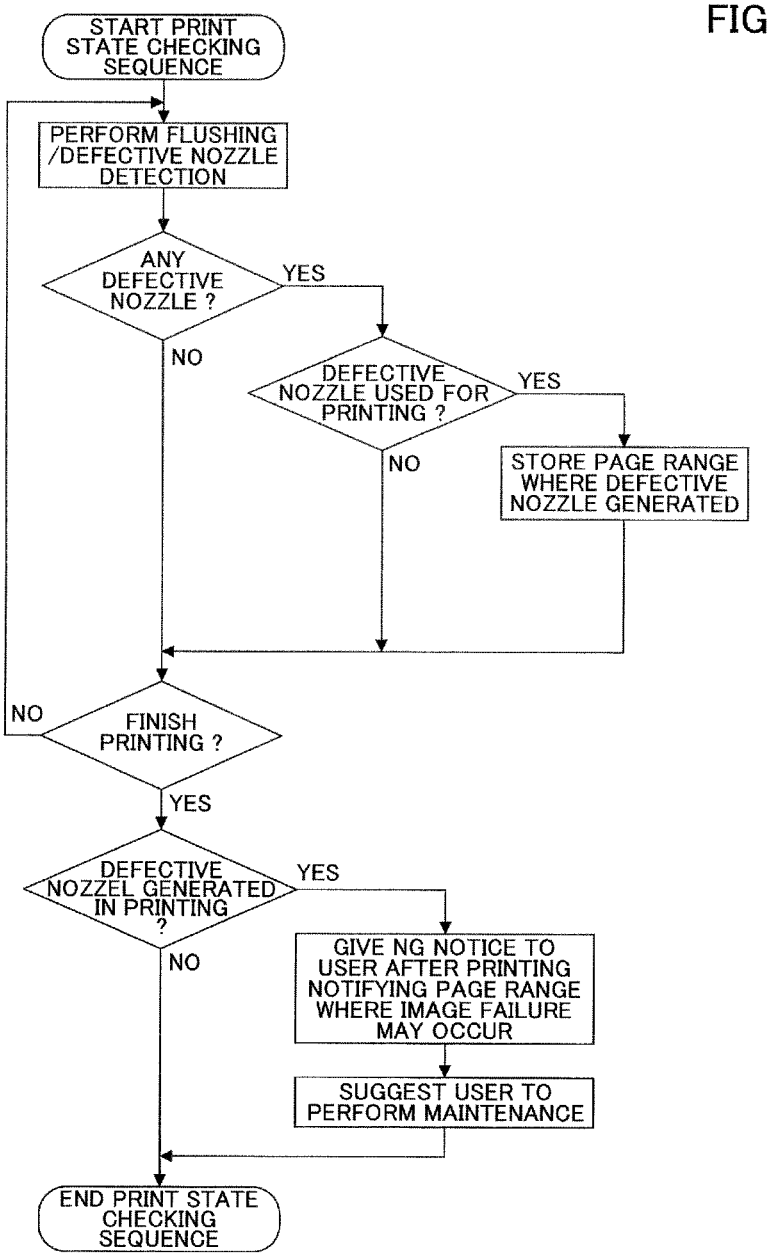
FIG. 9 is a flowchart illustrating an example of a print state checking sequence according to a first embodiment.

Next, a first embodiment of the present invention is described with reference to FIG. 9. FIG. 9 is a flowchart illustrating an example of a print state checking sequence according to the first embodiment.

When the print state checking sequence is started, a flushing operation and a defective nozzle detecting operation ("discharge failure detecting operation") are performed.

Then, it is determined whether there exists a defective nozzle ("discharge failure nozzle").

When, it is determined that there is no defective nozzle, it is further determined whether printing is completed. In this case, until the completion of printing, a process goes back to the step (process) where the flushing operation and the defective nozzle detecting operation ("discharge failure detecting operation") are performed. Here, the "flushing operation" refers to an operation to discharge liquid droplets which do not contribute to image formation.

On the other hand, when it is determined that there exists a defective nozzle, it is further determined whether the defective nozzle is used for printing (image formation).

Here, the determination whether the defective nozzle is used for printing may be made based on whether the defective nozzle is disposed outside the width of the recording medium 10 (i.e., outside of the print region). It is obvious that a nozzle disposed outside of the print region is not used in printing.

Therefore, by determining whether defective nozzle is disposed outside the width of the recording medium 10, it becomes possible to easily determine whether a defective nozzle is used for the printing.

Further, when it is determined that the defective nozzle is not used for printing, it is further determined whether printing is completed. In this case, until the completion of printing, a process goes back to the step (process) where the flushing operation and the defective nozzle detecting operation ("discharge failure detecting operation") are performed.

On the other hand, when it is determined that the defective nozzle is used for printing, a page range where the defective nozzle is generated is stored. After that, it is further determined whether printing is completed. Then, until the completion of printing, a process goes back to the step (process) where the flushing operation and the defective nozzle detecting operation ("discharge failure detecting operation") are performed.

During a period from when printing is started to when the printing is completed (in other words, a time period until a single printing job is finished), the flushing operation and the defective nozzle detecting operation ("discharge failure detecting operation") are repeatedly performed.

Due to the operations, there may be a case where there is no defective nozzle when printing is started but there exist a defective nozzle when printing is finished. Therefore, the above process is repeatedly performed to continuously detect the failure (defective nozzle).

Then, when printing is completed, it is determined whether a defective nozzle is generated during printing.

When it is determined that the defective nozzle is generated, the "NG notification" is given to the user. In the "NG notification", a range of pages where a defective image may be formed is notified. After that, it is suggested to the user to perform maintenance.

Then, the print state checking sequence is completed.

As described above, during starting image formation, a discharge failure nozzle is detected by a discharge failure detection unit. When it is determined that there exists a discharge failure nozzle by a determination unit, a notification of the possibility of forming a defective image is given after (or during) image formation.

By doing this, it becomes possible to reduce the case of possibly overlooking the image failure due to nozzle failure occurring during printing.

In this case, as the notification of the possibility of occurrence of forming a defective image, a notification may be given of existence of the discharge failure nozzle. Further, as described above, a notification may be given of a range of pages where a defective image may be formed.

By doing this, it may become easier to locate a part where a defective image due to the defective nozzle may be formed. As a result, it becomes possible to more reliably prevent (reduce) the case where a defective image due to a defective nozzle is overlooked.

Further, in this embodiment, even when a defective nozzle has occurred (generated), the notification may not be given during printing but may be given after printing. By doing this, it may become possible to remove the burden due to frequent display changes occurring whenever a defective nozzle is generated. However, the notification may be given even during printing.

Figure 10:
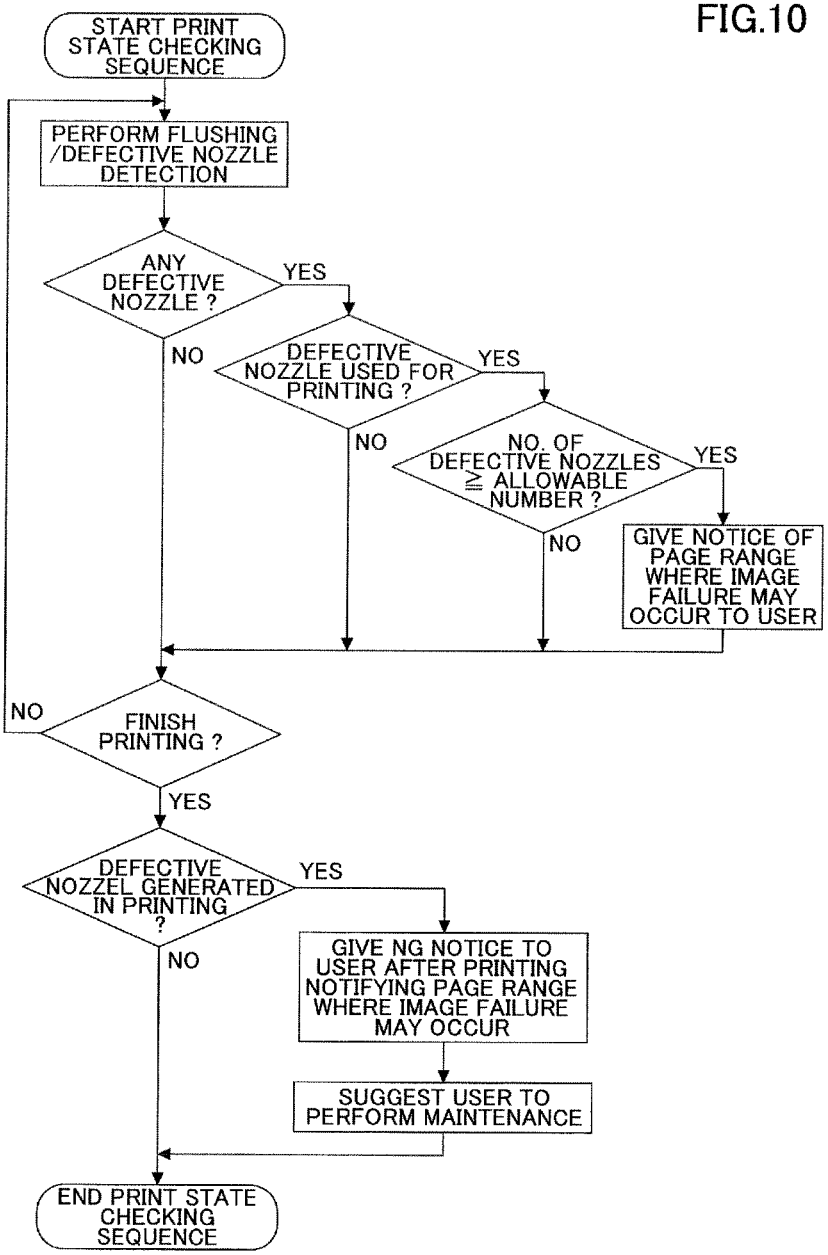
FIG. 10 is a flowchart illustrating an example of a print state checking sequence according to a second embodiment.

Next, a second embodiment is described with reference to FIG. 10. FIG. 10 is a flowchart illustrating an example of a print state checking sequence according to the second embodiment.

When the print state checking sequence is started, the flushing operation and the defective nozzle detecting operation ("discharge failure detecting operation") are performed.

Then, it is determined whether a defective nozzle ("discharge failure nozzle") exists.

When, it is determined that there is no defective nozzle, it is further determined whether printing is completed. Then, until the completion of printing, a process goes back to a step (process) where the flushing operation and the defective nozzle detecting operation ("discharge failure detecting operation") are performed.

On the other hand, when it is determined that there exists the defective nozzle, it is further determined whether the defective nozzle is used for the printing (image formation).

Here, when it is determined that the defective nozzle is not used for printing, it is further determined whether printing is completed. Then, until the completion of printing, a process goes back to a step (process) where the flushing operation and the defective nozzle detecting operation ("discharge failure detecting operation") are performed.

On the other hand, when it is determined that defective nozzle is used for printing, it is further determined whether the number of defective nozzles is greater than or equal to a predetermined allowable number.

Then, when it is determined that the number of the defective nozzles is not greater than or equal to (i.e., less than) the predetermined allowable number, it is further determined whether printing is completed. Then, until the completion of printing, a process goes back to a step (process) where the flushing operation and the defective nozzle detecting operation ("discharge failure detecting operation") are performed.

On the other hand, when it is determined that the number of defective nozzles is greater than or equal to the predetermined allowable number, a notification of the possibility of formation a defective image is given to the user.

After that, it is further determined whether printing is completed. Then, until the completion of printing, a process goes back to a step (process) where the flushing operation and the defective nozzle detecting operation ("discharge failure detecting operation") are performed.

Then, when printing is completed, it is determined whether the defective nozzle is generated during printing.

When it is determined that a defective nozzle is generated, the "NG notification" is given to the user. In the "NG notification", a range of pages where a defective image may be formed is notified. After that, it is suggested to the user perform maintenance.

Then, the print state checking sequence is completed.

As described above, in a case where the defective nozzle to be used for printing is generated, if the number of defective nozzles is less than the predetermined allowable number, printing continues. By doing this, it becomes possible to continue printing as long as influence to the image due to defective nozzle(s) is small. As a result, it becomes possible to reduce the occasions to stop printing without sufficient reason (necessity).

Here, the allowable number (allowable value) may be determined based on a threshold value which is determined when, for example, the generation of gloss variation or fixation reduction is started. Such gloss variation and fixation reduction in an image may occur when, for example, an overcoat is lost in a certain range in the image.

Otherwise, the allowable number (allowable value) may be input by the user. By allowing the user to set (input) the allowable number, it becomes possible for the user to determine the image quality level. As a result, it may become possible to remove the occasions to stop printing without necessity.

Figure 11:
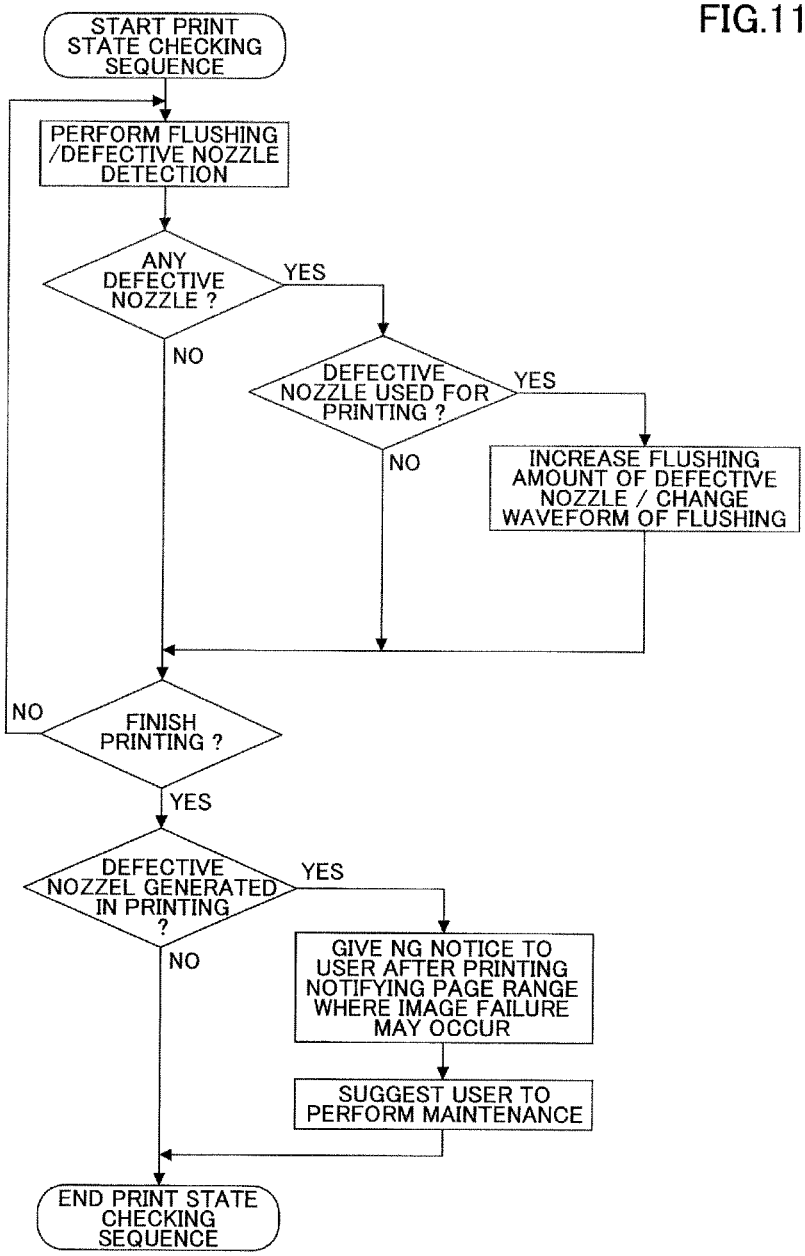
FIG. 11 is a flowchart illustrating an example of a print state checking sequence according to a third embodiment.

Next, a third embodiment is described with reference to FIG. 11. FIG. 11 is a flowchart illustrating an example of a print state checking sequence according to the third embodiment.

When the print state checking sequence is started, the flushing operation and the defective nozzle detecting operation ("discharge failure detecting operation") are performed.

Then, it is determined whether a defective nozzle ("discharge failure nozzle") exists.

When, it is determined that there is no defective nozzle, it is further determined whether printing is completed. Then, until the completion of printing, a process goes back to a step (process) where the flushing operation and the defective nozzle detecting operation ("discharge failure detecting operation") are performed.

On the other hand, when it is determined that a defective nozzle exists, it is further determined whether the defective nozzle is used for printing (image formation).

Here, when it is determined that the defective nozzle is not used for printing, it is further determined whether printing is completed. Then, until the completion of printing, a process goes back to a step (process) where the flushing operation and the defective nozzle detecting operation ("discharge failure detecting operation") are performed.

On the other hand, when it is determined that the defective nozzle is used for printing, a flushing amount of the defective nozzle is increased. Otherwise, after the waveform during flushing is changed, it is further determined whether printing is completed. Then, until the completion of printing, a process goes back to a step (process) where the flushing operation and the defective nozzle detecting operation ("discharge failure detecting operation") are performed.

Then, when printing is completed, it is determined whether the defective nozzle is generated during printing.

When it is determined that the defective nozzle is generated, the "NG notification" is given to the user. In the "NG notification", a range of pages where a defective image may be formed is notified. After that, it is suggested to the user to perform maintenance.

Then, the print state checking sequence is completed.

As described above, in a case where the defective nozzle is generated during printing and the defective nozzle is used for printing, the flushing amount to the defective nozzle is increased or a strong drive waveform (i.e., drive waveform in flushing). By doing this, recovery of the defective nozzle is attempted.

Namely, especially in a large line printer, it takes much time to move the head array to a maintenance position for maintenance (recovery). Therefore, even if the defective nozzle is generated during printing, printing does not stop for performing the recovery process on the defective nozzle.

Here, if the defective nozzle is used for printing, it is more likely that all the images formed after the generation of the defective nozzle become defective. To overcome the problem, when the defective nozzle is generated during printing, for example, a strong drive waveform is applied to attempt the recovery of the defective nozzle.

Figure 12:
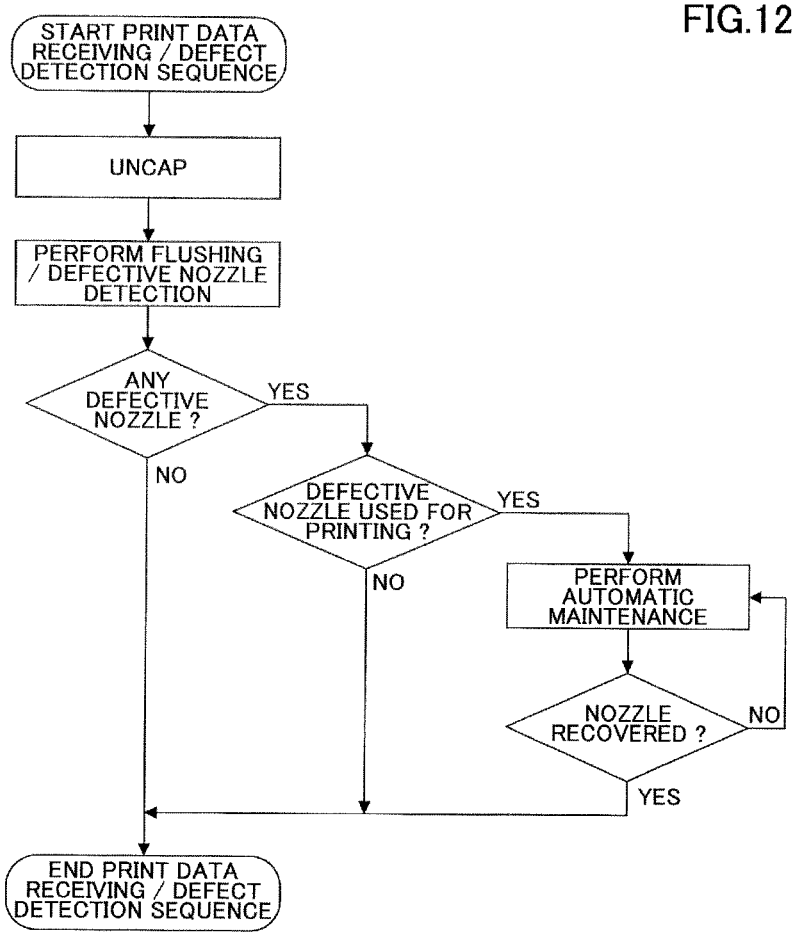
FIG. 12 is a flowchart illustrating an example of a print data reception/defect detection sequence which is performed before image formation according to a fourth embodiment.

Next, a fourth embodiment is described with reference to FIG. 12. FIG. 12 is a flowchart illustrating an example of a print data reception/defect detection sequence which is performed before image processing is started.

After the print data reception/defect detection sequence is started, the caps 91 of the maintenance unit 90 capping the heads 100 of the recording heads 51 are separated from the heads 100 (uncap).

After that, the flushing operation and the defective nozzle detecting operation ("discharge failure detecting operation") are performed.

Then, it is determined whether there exists a defective nozzle ("discharge failure nozzle").

When, it is determined that there is no defective nozzle, the defect detection sequence is terminated, and printing is started.

On the other hand, when it is determined that a defective nozzle exists, it is further determined whether the defective nozzle is used for printing (image formation).

In this case, it is determined that the defective nozzle is not used for printing (image formation), the defect detection sequence is terminated, and printing is started.

On the other hand, when it is determined that the defective nozzle is used for printing (image formation), an automatic maintenance is performed. Then, after the defective nozzle is recovered so that the nozzle can correctly discharge, the defect detection sequence is terminated and printing is started.

As described above, before starting the image formation, the defective nozzle detecting operation is performed to detect the defective nozzle. When the detected defective nozzle is not used for printing, printing is started. Here, it is not necessary to take time for performing the recovery operation on the nozzle which is not to be used for printing. Therefore, it becomes possible to reduce the time period before printing is started.

Figure 13:
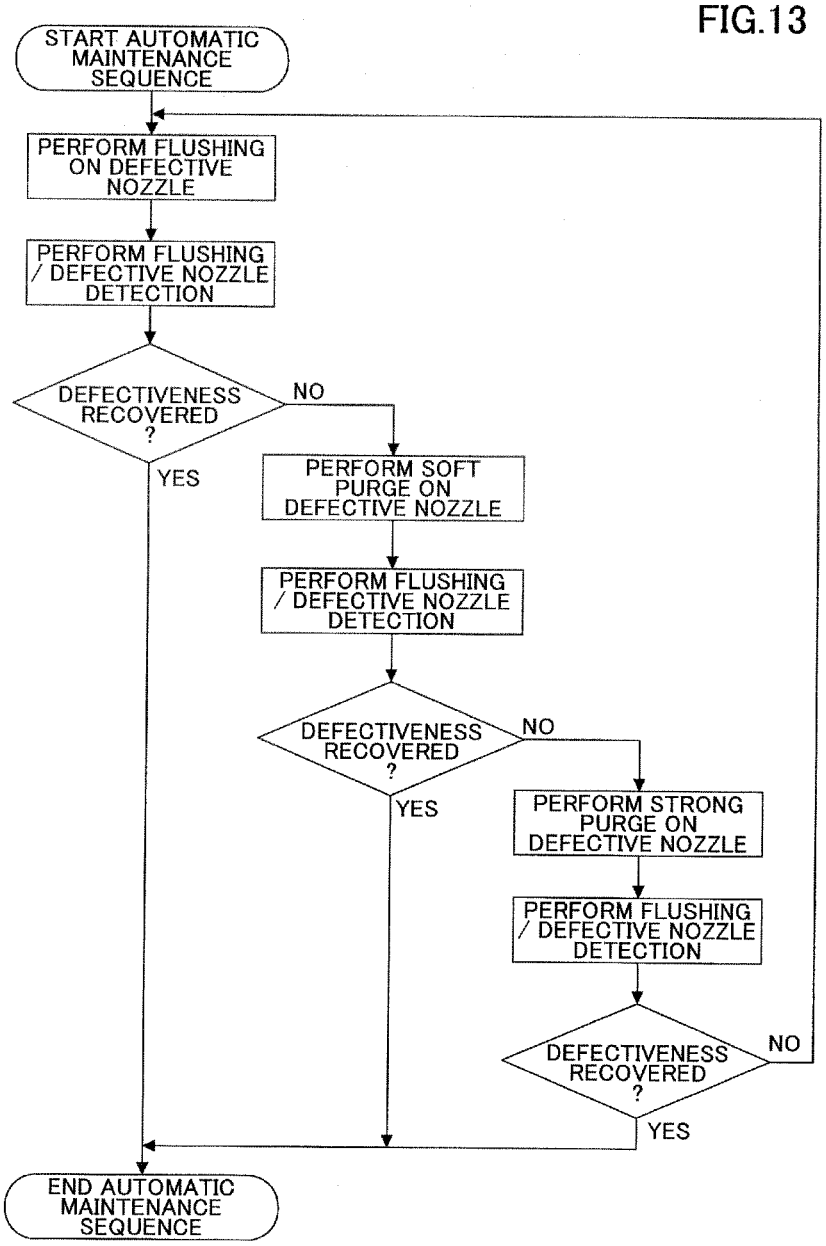
FIG. 13 is a flowchart illustrating an example of a recovery maintenance (auto maintenance sequence) when a damaged nozzle is detected according to a fifth embodiment.

Next, a fifth embodiment is described with reference to FIG. 13. FIG. 13 is a flowchart illustrating an example of a recovery maintenance (automatic maintenance) sequence when a defective nozzle is detected.

First, the flushing operation is performed on the defective nozzle. Then, the flushing operation and the defective nozzle detecting operation ("discharge failure detecting operation") are performed.

Then, it is determined whether the defect i.e., discharge failure) of the defective nozzle (discharge failure nozzle) is recovered.

Then, when the defect of the defective nozzle is recovered, the automatic maintenance) sequence is completed.

On the other hand, when the defect of the defective nozzle is not recovered, as a part of the cleaning operation, a soft purge operation is performed on the defective nozzle. Here, in the soft purge operation, for example, the nozzle surfaces of the heads 100 are capped with caps 91, so that liquid is forcibly absorbed (discharged) from the nozzles of the heads 100 by driving an absorption unit (i.e., suction pumps 93) connected to the caps 91. Otherwise, liquid is supplied with pressure to the heads 100 so as to forcibly discharge liquid with pressure from the nozzles.

Herein, it is noted that an amount of discharged liquid in the soft purge operation is less than that of a strong purge operation described below.

After that, the flushing operation is performed on the defective nozzle. Then, the flushing operation and the defective nozzle detecting operation ("discharge failure detecting operation") are performed.

Then, it is determined whether the defect of the defective nozzle is recovered.

When it is determines that the defect of the defective nozzle is recovered, the automatic maintenance sequence is completed.

On the other hand, when it is determined that the defect of the defective nozzle is not recovered, the strong purge operation is performed on the defective nozzle.

After that, the flushing operation is performed on the defective nozzle. Then, the flushing operation and the defective nozzle detecting operation ("discharge failure detecting operation") are performed.

Then, it is determined whether the defect of the defective nozzle is recovered.

When it is determines that the defect of the defective nozzle is recovered, the automatic maintenance sequence is completed.

On the other hand, when it is determined that the defect of the defective nozzle is not recovered, the process goes back to the step again where the flushing operation is performed on the defective nozzle.

As described above, in the maintenance, a smaller liquid consumption amount (liquid amount) is first applied to the head including the defective nozzle. By doing this, it becomes possible to reduce the liquid amount to be used for the recovery from the defect.

Namely, the recovery from the defect of the defective nozzle is performed by the flushing operation first. Then, if the defect remains, weak absorption (or pressure) is performed (applied). Then, if the defect remains, strong absorption (or pressure) is performed (applied).

Namely, herein, the discharge liquid amount is controlled in a manner that the discharge liquid amount (or the pressure applied to the discharge liquid droplets) in the flushing operation of the nozzle where the discharge failure is detected is greater than that of the nozzle where no discharge failure is detected during the image formation.

By doing this, it becomes possible to perform the recovery operation without unnecessarily increasing the liquid consumption amount.

Figure 14:
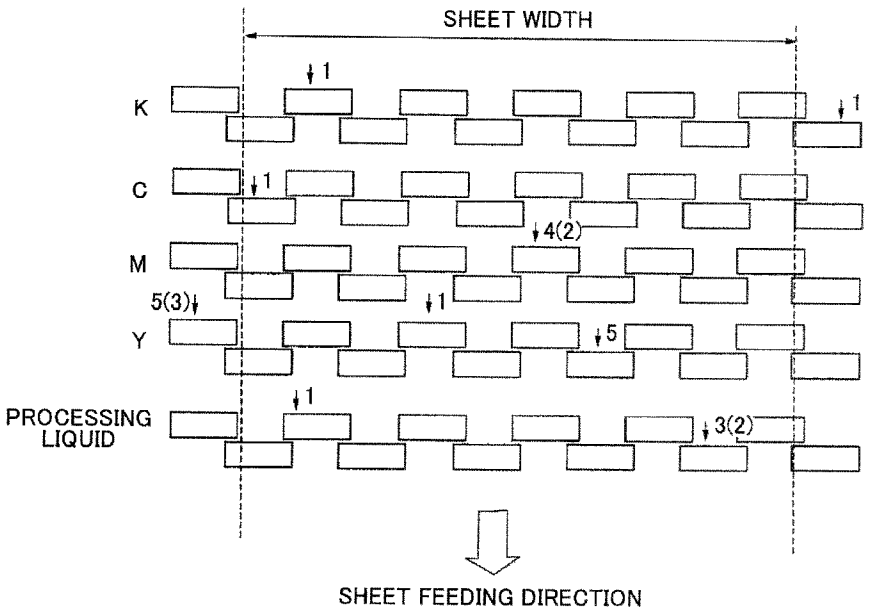
FIG. 14 illustrates an example of a notification given to a user according to a sixth embodiment.

Next, a sixth embodiment is described with reference to FIG. 14. FIG. 14 illustrates an example of a notification given to a user according to the sixth embodiment.

The notification may be displayed on, for example, the notification display unit 508. Otherwise, the operation section 507 may include a display part to display the notification. Here, the heads 100 of the recording head 51 and the processing liquid head 52 are displayed (in a rectangular shape), and the defective nozzles are also displayed.

The defective nozzles may be displayed as illustrated in FIG. 14. In this example, the defective nozzles are displayed using arrows. Namely, the arrows indicate the positions of the defective nozzles. There are numbers on the right side of the arrows. The numbers without parentheses denotes the number of lost nozzles (i.e., the nozzles are removed, e.g. "1" in FIG. 14).

The number with parentheses denotes the number of consecutive lost nozzles (i.e., the nozzles are removed consecutively, e.g. "(2)" in FIG. 14). It should be noted that the number of the nozzles that are removed consecutively (i.e., the number of discharged failures detected consecutively) indicates the influence of the image loss (data loss in the image) due to consecutive failures is more likely to be recognized.

Figure 15:
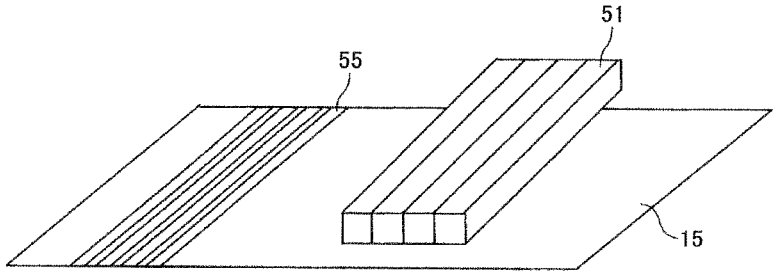
FIG. 15 is a perspective view illustrating an example of a flushing pattern.

Next, examples of flushing patterns are described with reference to FIGS. 15 and 16. FIG. 15 is a perspective view illustrating one example of a flushing pattern and FIG. 16 is a top view illustrating the example of the flushing pattern.

Figure 16:
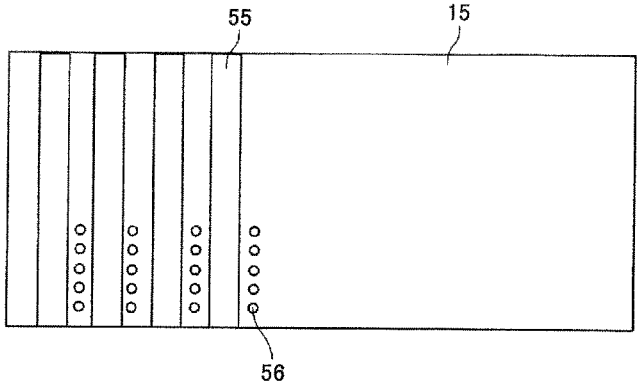
FIG. 16 is a top view illustrating the example of the flushing pattern.

In the flushing operation, the recording heads 51 discharges liquid droplets at the region (position) which does not contribute to image formation, using the flushing pattern 55 of FIGS. 15 and 16 to perform the recovery operation.

Further, the defective nozzle detecting operation herein is performed by discharging a liquid droplets 56 for detecting the defective nozzles onto the regions outside the flushing pattern 55 or on the flushing pattern 55.

In the present application, the material of the "sheet" is not limited to a paper alone. The material of the "sheet" may include, for example, a material of an OHP (Over Head Projector) sheet, fiber (cloth), glass, a substrate or the like to which liquid including ink droplets may be adhered. Further, the "sheet" may be a material called a "medium to be recorded", a "recording medium", a "recording sheet", a "recording paper" and the like. Further, it is assumed that the terms "image formation", "recording", "printing", "print", "image printing" and the like are synonymous words.

Further, the term "image forming apparatus" refers to an apparatus performing image formation by discharging liquid onto a medium including a paper, strings, fibers, cloth, leather, metal, plastic, glass, wood, ceramic or the like.

Further, the term "image formation" refers not only to applications of an image having a meaning such as a character, a figure or the like but also to the application of meaningless images to a medium (e.g., simply discharging liquid droplets to a medium).

The term "ink" is not limited to a liquid called "ink" unless otherwise described and is collectively used to represent all the materials that are called "recording liquid", "fixing treatment liquid", "liquid" and the like and that are used for image formation. Therefore, the term "ink" may include a "DNA sample", "resist", "pattern material", "resin" and the like.

Further, the "image" is not limited to a planate one but does include an image applied on a medium and the like which are three-dimensionally formed, and an image formed by three-dimensionally molding a solid object.

Further, the image forming apparatus according to an embodiment includes an image forming apparatus employing an electrophotographic method.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a liquid discharge head including a plurality of nozzles discharging liquid droplets;

a discharge failure detection unit configured to detect a defective nozzle of the liquid discharge head, the defective nozzle having a discharge failure;

a determination unit configured to determine whether the defective nozzle is used for image formation;

a control unit configured to perform a flushing operation that discharges liquid droplets at positions which do not contribute to the image formation, the liquid droplets being discharged from the liquid discharge head during the image formation, and control a liquid amount to be discharged in a manner that a liquid discharge amount or a pressure to be applied for discharging droplets from the defective nozzle is greater than the liquid discharge amount or the pressure to be applied for discharging droplets from nozzles other than the defective nozzle;

a notice display unit to display notification display information; and a notification unit configured to, when the defective nozzle is detected and the determination unit determines that the defective nozzle is used for the image formation, cause a notification of the possibility of the generation of an image failure to be displayed on the notice display unit at least one of during and after the image formation, wherein when the discharge failure detection unit detects the defective nozzle during the image formation in a print job exceeding one page, the image forming apparatus continues to perform print operation from start of the print job to end of the print job without being stopped due to detection of the defective nozzle, and the notification displayed on the notice display unit indicates a page range where a defective image may be formed due to the defective nozzle.

2. The image forming apparatus according to claim 1, wherein, during the print operation, the discharge failure detection unit is configured to repeatedly detect the defective nozzle.

3. The image forming apparatus according to claim 2, further comprising:

a control unit configured to, when the discharge failure detection unit detects the discharge failure during the print state, repeatedly perform a flushing operation that discharges liquid droplets which do not contribute to the image formation.

4. The image forming apparatus according to claim 1, wherein the liquid discharge head includes a first liquid discharge head discharging liquid droplets of recording liquid and a second liquid discharge head discharging transparent processing liquid.

5. The image forming apparatus according to claim 1, further comprising: a recovery unit configured to recover a state of the nozzles of the liquid discharge head; and a control unit configured to control recovery of the state of the defective nozzles before the image formation is started when the determination unit determines that the defective nozzle is used for the image formation.

* * * * *